US009942675B2

(12) United States Patent
Tull

(10) Patent No.: US 9,942,675 B2
(45) Date of Patent: Apr. 10, 2018

(54) SYNCHRONISING AN AUDIO SIGNAL

(71) Applicant: Power Chord Group Limited, Exeter, Devon (GB)

(72) Inventor: Graham Tull, Exeter (GB)

(73) Assignee: POWERCHORD GROUP LIMITED, Devon (GB)

( * ) Notice: Subject to any disclaimer, the term of this patent is extended or adjusted under 35 U.S.C. 154(b) by 0 days.

(21) Appl. No.: 15/049,342

(22) Filed: Feb. 22, 2016

(65) Prior Publication Data

US 2017/0019743 A1 Jan. 19, 2017

(30) Foreign Application Priority Data

Jul. 16, 2015 (GB) ..... 1512450.6

(51) Int. Cl.
*H04R 27/00* (2006.01)
*H04R 3/12* (2006.01)

(52) U.S. Cl.
CPC ..... *H04R 27/00* (2013.01); *H04R 3/12* (2013.01); *H04R 2227/003* (2013.01); *H04R 2227/007* (2013.01); *H04R 2420/07* (2013.01)

(58) Field of Classification Search
CPC ..... H04S 7/30; H04S 3/008; H04R 1/403; G01H 7/00; H04H 60/04; H03G 3/3089; G06F 3/165
USPC ..... 381/161, 310, 58, 107, 303, 17; 700/94
See application file for complete search history.

(56) References Cited

U.S. PATENT DOCUMENTS

| | | | | |
|---|---|---|---|---|
| 5,822,440 | A | 10/1998 | Oltman et al. | |
| 7,995,770 | B1 | 8/2011 | Simon | |
| 8,588,432 | B1 | 11/2013 | Simon | |
| 9,411,882 | B2 * | 8/2016 | Cory | H04S 7/30 |
| 2003/0007648 | A1 * | 1/2003 | Currell | H04S 7/30 381/61 |
| 2003/0063760 | A1 | 4/2003 | Cresci et al. | |

(Continued)

FOREIGN PATENT DOCUMENTS

| | | | |
|---|---|---|---|
| CN | 2904481 | Y | 5/2007 |
| DE | 10 2008 033599 | A1 | 1/2010 |

(Continued)

OTHER PUBLICATIONS

Internatioal Search Report dated Oct. 13, 2015 issued in corresponding United Kingdom Application No. GB1512450.6.

(Continued)

*Primary Examiner* — Mohammad Islam
(74) *Attorney, Agent, or Firm* — Morris & Kamlay LLP

(57) ABSTRACT

A method of synchronizing one or more wirelessly received audio signals with an acoustically received audio signal is provided. The method comprises: receiving an electromagnetic signal using a first wireless communication method, the electromagnetic signal comprising: the one or more wirelessly received audio signals and a wirelessly received metadata relating to a remote audio content, determining a delay between the acoustically received audio signal and the one or more wirelessly received audio signals by referring the acoustically received audio signal to the wirelessly received metadata; and delaying the one or more audio signals by the determined delay. A device and system for performing the method are also provided.

19 Claims, 4 Drawing Sheets

(56) References Cited

U.S. PATENT DOCUMENTS

| | | | | |
|---|---|---|---|---|
| 2007/0269062 | A1* | 11/2007 | Rodigast | H04R 1/403 381/310 |
| 2008/0071402 | A1 | 3/2008 | Igoe | |
| 2009/0220104 | A1 | 9/2009 | Allison | |
| 2010/0150359 | A1* | 6/2010 | Knickrehm | G01H 7/00 381/58 |
| 2012/0059492 | A1* | 3/2012 | Radford | H04H 60/04 700/94 |
| 2012/0087507 | A1 | 4/2012 | Meyer | |
| 2012/0195445 | A1 | 8/2012 | Inlow | |
| 2012/0288121 | A1* | 11/2012 | Matsui | H03G 3/3089 381/107 |
| 2014/0133683 | A1* | 5/2014 | Robinson | H04S 3/008 381/303 |
| 2014/0328485 | A1* | 11/2014 | Saulters | G06F 3/165 381/17 |

FOREIGN PATENT DOCUMENTS

| | | | |
|---|---|---|---|
| EP | 2007045 | A2 | 12/2008 |
| EP | 2658209 | A2 | 10/2013 |
| GB | 2436193 | A | 9/2007 |
| WO | WO-94/04010 | A1 | 2/1994 |
| WO | WO-2006/049370 | A1 | 5/2006 |
| WO | WO-2013/083133 | A1 | 6/2013 |

OTHER PUBLICATIONS

International Search Report dated Oct. 19, 2015 issued in corresponding United Kingdon Patent Application No. 1512444.9.

Combined International Search and Examination Report dated Jan. 29, 2016 issued in corresponding United Kingdom Patent Application No. 1512457.1.

International Search Report and Written Opinion for PCT/GB2016/052142 dated Oct. 5, 2015.

International Search Report and Written Opinion for PCT/GB2016/052139 dated Oct. 10, 2016.

International Search Report and Written Opinion for PCT/GB2016/0521326 dated Oct. 20, 2016.

Office Action dated Aug. 22, 2017 as received in GB Application No. 1512457.1.

U.S. Appl. No. 15/049,349, filed Feb. 22, 2016, Tull.

U.S. Appl. No. 15/049,393, filed Feb. 22, 2016, Tull.

* cited by examiner

SYNCHRONISING AN AUDIO SIGNAL

CROSS-REFERENCE TO RELATED APPLICATIONS

This application claims the benefit and priority of United Kingdom Patent Application No. 1512450.6 filed on Jul. 16, 2015. The entire disclosure of the above application is incorporated herein by reference.

The subject application includes subject matter similar to U.S. patent application Ser. No. 15/049,349, entitled "A Method of Augmenting an Audio Content", filed concurrently herewith; and U.S. patent application Ser. No. 15/049,393, entitled "Personal Audio Mixer", filed concurrently herewith, both of which are incorporated herein by reference.

FIELD

The present invention relates to a method of synchronising an audio signal. A device and system for performing the method are also provided.

BACKGROUND

Music concerts and other live events are increasingly being held in large venues such as stadiums, arenas and large outdoor spaces such as parks. With increasingly large venues being used, the challenge of providing a consistently enjoyable audio experience to all attendees at the event, regardless of their location within the venue, is becoming increasingly challenging.

All attendees at such events expect to experience a high quality of sound, which is either heard directly from the acts performing on the stage, or reproduced from speaker systems at the venue. Multiple speaker systems distributed around the venue may often be desirable to provide a consistent sound quality and volume for all audience members. In larger venues, the sound reproduced from speakers further from the stage may be delayed such that attendees, who are standing close to distant speakers, do not experience an echo or reverb effect as sound from speakers nearer the stage reaches them.

In some cases such systems may be unreliable and reproduction of the sound may be distorted due to interference between the sound produced by different speaker systems around the venue. Additionally, if multiple instrumentalists and/or vocalists are performing simultaneously on the stage, it may be very challenging to ensure the mix of sound being projected throughout the venue is correctly balanced in all areas to allow the individual instruments and/or vocalists to be heard by each of the audience members. Catering for all the individual preferences of the attendees in this regard may be impossible.

SUMMARY

According to an aspect of the present disclosure, there is provided a method of synchronising one or more wirelessly received audio signals with an acoustically received audio signal, the method comprising: receiving an electromagnetic signal using a first wireless communication method, the electromagnetic signal comprising: the one or more wirelessly received audio signals and a wirelessly received metadata relating to a remote audio content, determining a delay between the acoustically received audio signal and the one or more wirelessly received audio signals by referring the acoustically received audio signal to the wirelessly received metadata and delaying the one or more audio signals by the determined delay.

The acoustically received audio signal may be recorded, e.g. by a transducer, such as a microphone, configured to convert an ambient audio content, into the acoustically received audio signal. The remote audio content may be configured to correspond to the ambient audio content and/or the acoustically received audio signal.

According to an aspect of the present disclosure, there is provided a method of synchronising one or more wirelessly received audio signals with an acoustically received audio signal, the method comprising: recording the acoustically received audio signal from an ambient audio content, receiving an electromagnetic signal using a first wireless communication method, the electromagnetic signal comprising: the one or more wirelessly received audio signals and a wirelessly received metadata relating to a remote audio content, determining a delay between the acoustically received audio signal and the one or more wirelessly received audio signals by referring the acoustically received audio signal to the wirelessly received metadata and delaying the one or more audio signals by the determined delay.

The method may further comprise processing the acoustically received audio signal to determine an acoustic metadata. The delay between the acoustically received audio signal and the one or more wirelessly received audio signals may be determined by comparing the acoustic metadata with the wirelessly received metadata.

The wirelessly received metadata may comprise timing information relating to the remote audio content. Additionally or alternatively, the wirelessly received metadata may comprise information relating to a waveform of the remote audio content.

The electromagnetic signal may comprise a multiplexed audio signal. Additionally or alternatively, the wireless signal may be a modulated signal, e.g. a digitally modulated signal. The method may further comprise demultiplexing and/or demodulating (e.g. decoding) the electromagnetic audio signal to obtain the one or more wirelessly received audio signals and/or the wirelessly received metadata.

The electromagnetic signal may comprise a plurality of wirelessly received audio signals. The method may further comprise receiving an audio content setting from a user interface device and adjusting the relative volumes of the wirelessly received audio signals, according to the audio content setting, to provide a plurality of adjusted audio signals. The adjusted audio signals may be combined to generate a custom audio content.

At least one of the wirelessly received audio signals may correspond to the remote audio content.

The audio content setting may be received using a second wireless communication method. The first wireless communication method may have a longer range than the second wireless communication method.

According to another aspect of the present disclosure, there is provided an audio synchroniser comprising: a wireless receiver configured to receive an electromagnetic signal using a first wireless communication method, the signal comprising one or more wirelessly received audio signals and a wirelessly received metadata relating to a remote audio content, and a controller configured to perform the method, for example according to a previously mentioned aspect of the disclosure.

According to another aspect of the disclosure, there is provided a system for synchronising one or more wirelessly received audio signals with an acoustically received audio signal, the system comprising: an audio workstation configured to generate a metadata relating to an audio content and provide a signal comprising one or more audio signals and the metadata, a transmitter configured to receive the signal from the audio workstation and transmit the signal using a first wireless communication method, and the audio synchroniser according to a previously mentioned aspect of the disclosure.

The audio workstation may be configured to generate the audio content from a plurality of audio channels provided to the audio workstation. Additionally or alternatively, the audio workstation may be configured to generate the one or more audio signals from the plurality of audio channels provided to the audio workstation. At least one of the audio signals may correspond to the audio content. The audio content may be configured to correspond to the acoustically received audio signal and/or an ambient audio content at the location of the audio synchroniser.

The system may further comprise a speaker system configured to provide the ambient audio content.

According to another aspect of the present disclosure, there is provided software configured to perform the method according to a previously mentioned aspect of the disclosure.

To avoid unnecessary duplication of effort and repetition of text in the specification, certain features are described in relation to only one or several aspects or embodiments of the disclosure. However, it is to be understood that, where it is technically possible, features described in relation to any aspect or embodiment of the disclosure may also be used with any other aspect or embodiment of the disclosure.

DRAWINGS

For a better understanding of the present disclosure, and to show more clearly how it may be carried into effect, reference will now be made, by way of example, to the accompanying drawings, in which.

DETAILED DESCRIPTION

Figure 1:
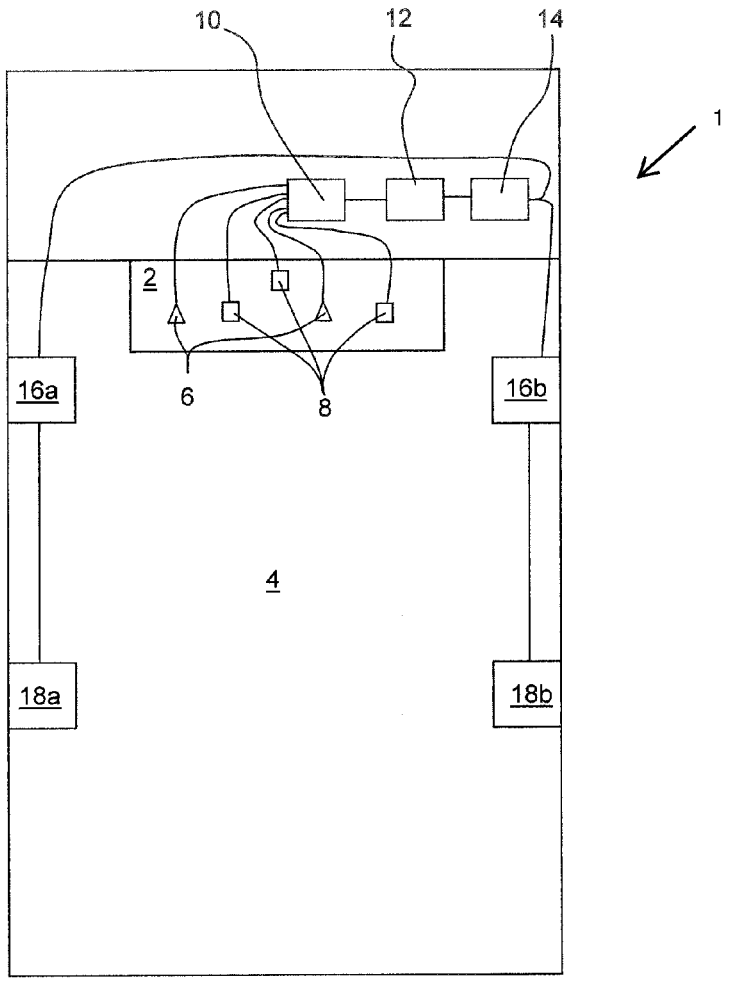
FIG. 1 is a schematic view of a previously proposed arrangement of sound recording, mixing and reproduction apparatus for a large outdoor event.

With reference to FIG. 1, a venue for a concert or other live event comprises a performance area, such as a stage 2, and an audience area 4. The audience area may comprise one or more stands of seating in a venue such as a theatre or arena. Alternatively, the audience area may be a portion of a larger area such as a park, within which it is desirable to see and/or hear a performance on the stage 2. In some cases the audience area 4 may be variable, being defined by the crowd of people gathered for the performance.

Figure 2:
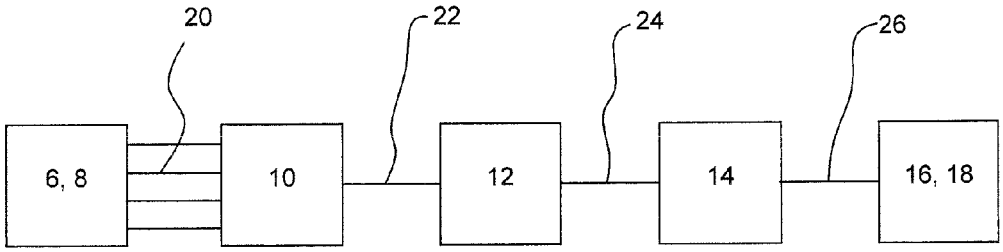
FIG. 2 is a schematic view showing the process of recording, processing and reproducing sound within the arrangement shown in FIG. 1.

With reference to FIGS. 1 and 2, the sound produced by instrumentalists and vocalists performing on the stage 2 is picked up by one or more microphone 6 and/or one or more instrument pick-ups 8 provided on the stage 2. The microphones 6 and pick-ups 8 convert the acoustic audio into a plurality of audio signals 20. The audio signals 20 from the microphones 6 and pick-ups 8 are input as audio channels into a stage mixer 10, which adjusts the relative volumes of each of the channels.

The relative volumes of each of the audio channels mixed by the stage mixer 10 are set by an audio technician prior to and/or during the performance. The relative volumes may be selected to provide what the audio technician considers to be the best mix of instrumental and vocal sounds to be projected throughout the venue. In some cases performers may request that the mix is adjusted according to their own preferences.

The mixed, e.g. combined, audio signal 22 output by the stage mixer 10 is input into a stage equaliser 12, which can be configured to increase or decrease the volumes of certain frequency ranges within the mixed audio signal. The equalisation settings may be selected by the audio technician and/or performers according to their personal tastes and may be selected according to the acoustic environment of the venue and the nature of the performance.

The mixed and equalised audio signal 24 is then input to a stage amplifier 14 which boosts the audio signal to provide an amplified signal 26, which is provided to one or more front speakers 16*a*, 16*b* to project the audio signal as sound. Additional speakers 18*a*, 18*b* are often provided within the venue to project the mixed and equalised audio to attendees located towards the back of the audience area 4. Sound from the front speakers 16*a*, 16*b* reaches audience members towards the back of the audience area 4 a short period of time after the sound from the additional speaks 18*a*, 18*b*. In large venues, this delay may be detectable by the audience members and may lead to echoing or reverb type effects. In order to avoid such effects, the audio signal provided to the additional speakers 18*a* 18*b* is delayed before being projected into the audience area 4. The signal may be delayed by the additional speakers 18*a*, 18*b*, the stage amplifier 14, or any other component or device within the arrangement 1. Sound from the speakers 16*a*, 16*b* and the additional speakers 18*a*, 18*b* will therefore reach an attendee towards the rear of the audience area 4 at substantially the same time, such that no reverb or echoing is noticeable.

Owing to the mixed and equalised sounds being reproduced by multiple speaker systems throughout the venue, some of which are configured to delay the signal before reproducing the sound, interference may occur between the projected sounds waves in certain areas of the venue which deteriorates the quality of audible sound. For example, certain instruments and/or vocalists may become indistinguishable, not clearly audible or substantially inaudible within the overall sound. In addition to this, the acoustic qualities of the venue may vary according to the location within the venue and hence the equalisation of the sound may be disrupted for some audience members. For example, the bass notes may become overly emphasised.

As described above, the mix and equalisation of the sound from the performance may be set according to the personal tastes of the audio technician and/or the performers. However, the personal tastes of the individual audience members may vary from this and may vary between the audience members. For example a certain audience member may prefer a sound in which the treble notes are emphasised more than in the sound being projected from the speakers, whereas another audience member may be particularly interested in hearing the vocals of a song being performed and may prefer a mix in which the vocals are more distinctly audible over the sounds of other instruments.

Figure 3:
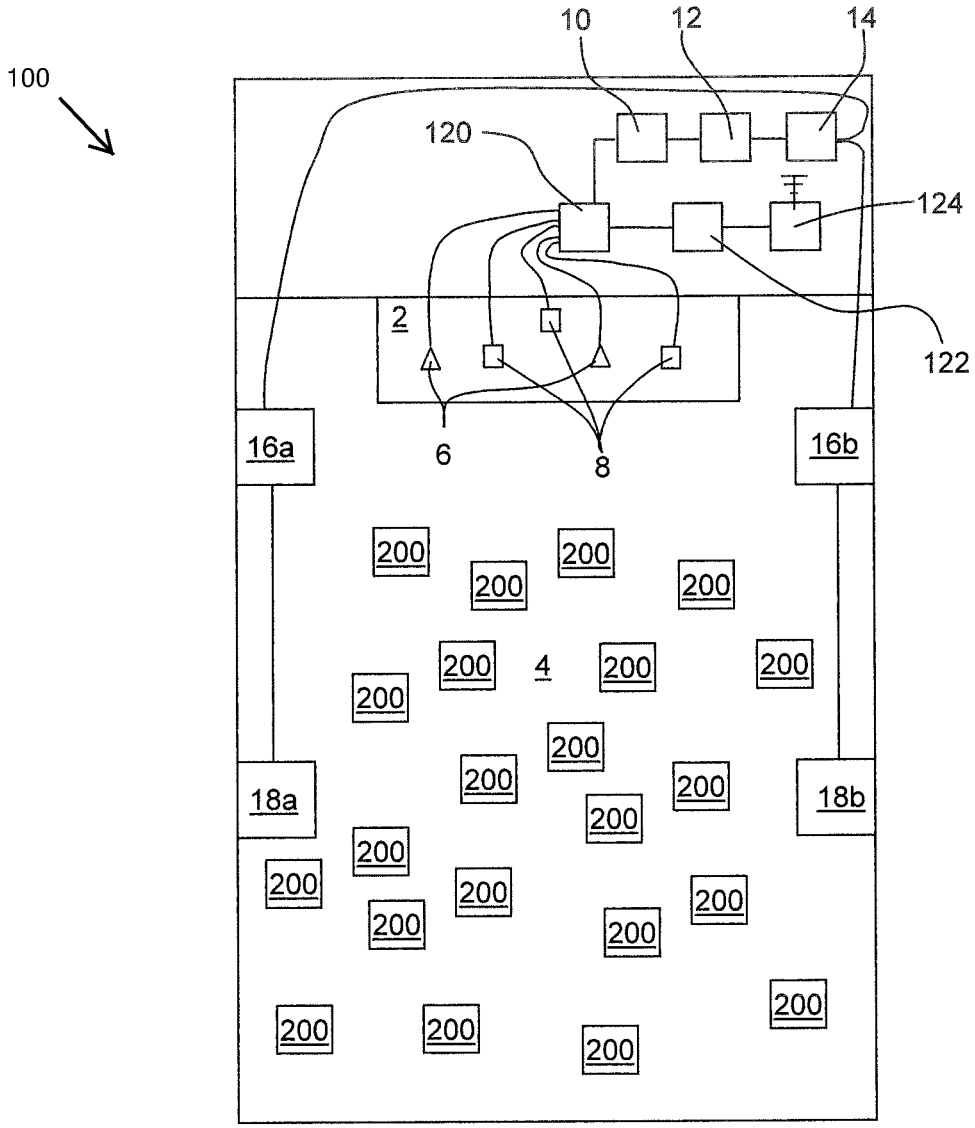
FIG. 3 is a schematic view of an arrangement of sound recording, mixing and reproduction apparatus, according to an embodiment of the present disclosure, for a large outdoor event.
Figure 4:
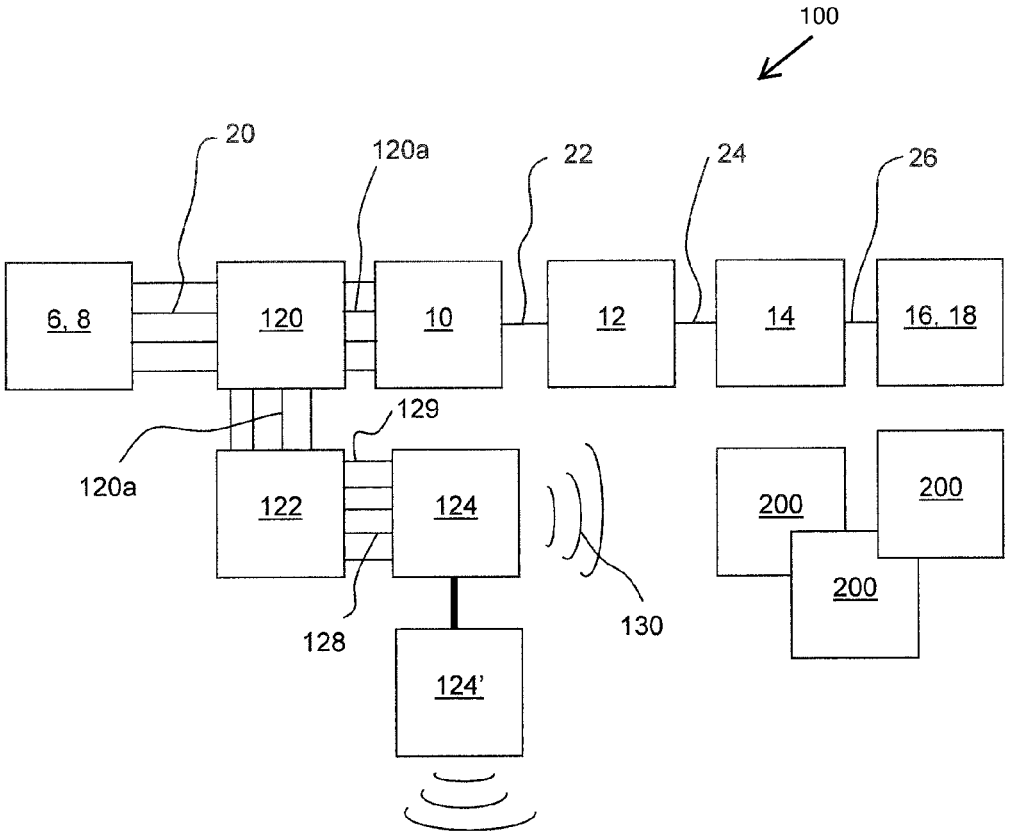
FIG. 4 is a schematic view showing the process of recording, processing and reproducing sound within the arrangement shown in FIG. 3.

With reference to FIGS. 3 and 4, in order to provide an improved quality and consistency of audio experienced for each audience member attending a performance and to allow the mix and equalisation of the audio to be individually adjusted by each audience member, an arrangement 100 of sound recording, mixing and reproduction apparatus, according to an embodiment of the present disclosure, is provided. The apparatus within the arrangement 100 is configured to record, mix and reproduce audio signals following a process.

The arrangement 100 comprises the microphones 6, instrument pick-ups 8, stage mixer 10, stage equaliser 12 and stage amplifier 14, which provide audio signals to drive the front speakers 16*a*, 16*b* and additional speakers 18*a*, 18*b* as described above with reference to the arrangement 1. The arrangement 100 further comprises a stage audio splitter 120, an audio workstation 122, a multi-channel transmitter 124 and a plurality of personal audio mixing devices 200.

The stage audio splitter 120 is configured to receive the audio signals 20 from each of the microphones 6 and instrument pick-ups 8, and split the signals to provide inputs 120*a* to the stage mixer 10 and the audio workstation 122. The inputs 120*a* received by the stage mixer 10 and the audio workstation 122 are substantially the same as each other, and are substantially the same as the inputs 20 received by the stage mixer 10 in the arrangement 1, described above. This allows the stage mixer 10 and components which receive their input from the stage mixer 10 to operate as described above.

The audio workstation 122 comprises one or more additional audio splitting and mixing devices, which are configured such that each mixing device is capable of outputting a combined audio signal 128 comprising a different mix of each of the audio channels 120*a*, e.g. the relative volumes of each of the audio signals 120*a* within each one or the combined audio signals 128 are different to within each of the other combined audio signals 128 output by the other mixing devices. At least one of the combined audio signals 128 generated by the audio workstation 122 may correspond to the stage mix being projected from the speakers 16 and additional speakers 18.

The audio workstation 122 may comprise a computing device, or any other system capable of processing the audio signal inputs 120*a* from the stage audio splitter 120 to generate the plurality of combined audio signals 128.

The audio workstation 122 is also configured to generate an audio content that is substantially the same as the stage mix generated by the stage mixer 10. The audio content may be configured to correspond to the sound projected from the speakers 16 and the additional speakers 18. The audio workstation 122 is configured to process the audio content to generate metadata 129, e.g. a metadata stream, corresponding to the audio content. The metadata may relate to the waveform of the audio content. Additionally or alternatively, the metadata may comprise timing information relating to the audio content. The metadata may be generated by the audio workstation 122 substantially in real time, such that the stream of metadata 129 is synchronised with the combined audio signals 128 output from the audio workstation 122.

The combined audio signals 128 and metadata 129 output by the audio workstation 122 are input to a multi-channel transmitter 124. The multi-channel transmitter 124 is configured to transmit the combined audio signals 128 and metadata 129 as one or more wireless signal 130, using wireless communication, such as radio, digital radio, Wi-Fi (such as RTM), or any other wireless communication method. The multi-channel transmitter 124 is also capable of relaying the combined audio signals 128 and metadata 129 to one or more further multi-channel transmitters 124' using a wired or wireless communication method. Relaying the combined audio signals and metadata allows the area over which the combined audio signals and metadata is transmitted to be extended.

Each of the combined audio signals 128 and the metadata 129 may be transmitted separately using a separate wireless communication channel, bandwidth, or frequency. Alternatively, the combined audio signals 128 and metadata 129 may be modulated, e.g. digitally modulated, and/or multiplexed together and transmitted using a single communication channel, bandwidth or frequency. For example, the combined audio signals 128 and metadata 129 may be encoded using a Quadrature Amplitude Modulation (QAM) technique, such as 16-bit QAM. The wireless signals 130 transmitted by the multi-channel transmitter 124 are received by the plurality of personal audio mixing devices 200.

Figure 5:
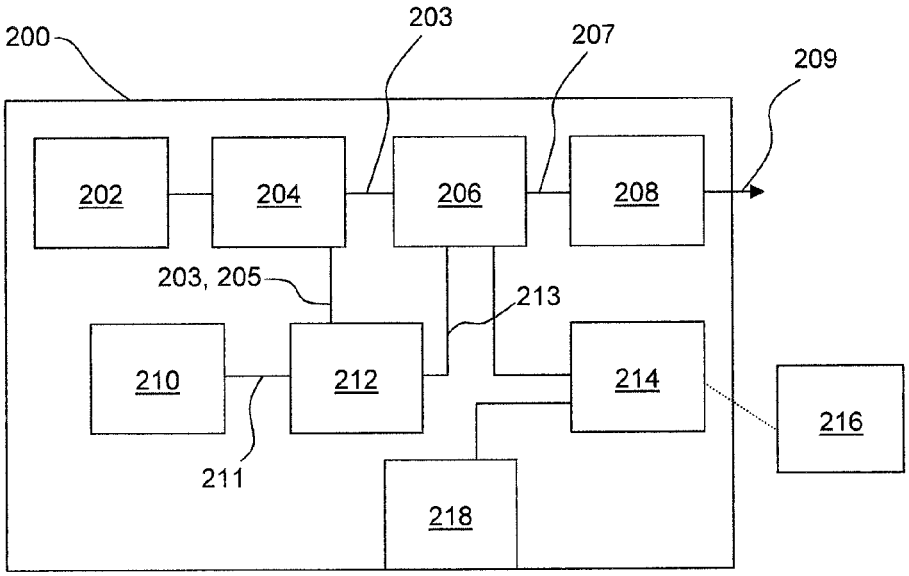
FIG. 5 is a schematic view of a system for mixing a custom audio content according to an embodiment of the present disclosure.

With reference to FIG. 5, the personal audio mixing devices 200, according to an arrangement of the present disclosure, comprise an audio signal receiver 202, a decoder 204, a personal mixer 206, and a personal equaliser 208.

The audio signal receiver 202 is configured to receive the wireless signal 130 comprising the combined audio signals 128 and the metadata 129 transmitted by the multi-channel transmitter 124. As described above, the multi-channel transmitter 124 may encode the signal, for example using a QAM technique. Hence, the decoder 204 may be configured to demultiplex and/or demodulate (e.g. decode) the received signal as necessary to recover each of the combined audio signals 128 and the metadata 129, as one or more decoded audio signals 203, and wirelessly received metadata 205.

As described above, the combined audio signals 128 each comprise a different mix of audio channels 20 recorded from the instrumentalists and/or vocalists performing on the stage 2. For example, a first combined audio signal may comprise a mix of audio channels in which the volume of the vocals has been increased with respect to the other audio channels 20; in a second combined audio signal the volume of an audio channel from the instrument pick-up of a lead guitarist may be increased with respect to the other audio channels 20. The decoded audio signals 203 are provided as inputs to the personal mixer 206.

The personal mixer 206 may be configured to vary the relative volumes of each of the decoded audio signals 203. The mix created by the personal mixer 206 may be selectively controlled by a user of the personal audio mixer device 200, as described below. The user may set the personal mixer 206 to create a mix of one or more of the decoded audio signals 203.

In a particular arrangement, each of the combined audio signals 128 is mixed by the audio workstation 122 such that each signal comprises a single audio channel 20 recorded from one microphone 6 or instrument pick-up 8. The personal mixer 206 can therefore be configured by the user to provide a unique personalised mix of audio from the performers on the stage 2. The personal audio mix may be configured by the user to improve or augment the ambient sound, e.g. from the speakers and additional speakers 16, 18, heard by the user.

A mixed audio signal 207 output from the personal mixer 206 is processed by a personal equaliser 208. The personal equaliser 208 is similar to the stage equaliser 12 described above and allows the volumes of certain frequency ranges within the mixed audio signal 207 to be increased or decreased. The personal equaliser 208 may be configured by a user of the personal audio mixer device 200 according to their own listening preferences.

An equalised audio signal 209 from the personal equaliser 208 is output from the personal audio mixing device 200 and may be converted to sound, e.g. by a set of personal head phones or speakers (not shown), allowing the user, or a group of users to listen to the personal audio content created on the personal audio mixing device 200.

Each member of the audience may use their own personal audio mixing device 200 to listen to a personal, custom audio content at the same time as listening to the stage mix being projected by the speakers 16 and additional speakers 18. The pure audio reproduction of the performance provided by the personal audio mixing device 200 may be configured as desired by the user to complement or augment the sound being heard from the speaker systems 16, 18, whilst retaining the unique experience of the live event.

If desirable, the user may listen to the personal, custom audio content in a way that excludes other external noises, for example by using noise cancelling/excluding headphones.

In order for the user of the personal audio mixing device 200 to configure the personal mixer 206 and personal equaliser 208 according to their preferences, the personal audio mixing device 200 may comprise one or more user input devices, such as buttons, scroll wheels, or touch screen devices (not shown). Additionally or alternatively, the personal audio mixing device 200 may comprise a user interface communication module 214.

As shown in FIG. 5, the user interface communication module 214 is configured to communicate with a user interface device 216. The user interface device 216 may comprise any portable computing device capable of receiving input from a user and communicating with the user interface communication module 214. For example, the user interface device 216 may be a mobile telephone or tablet computer. The user interface communication module 214 may communicate with the user interface device 216 using any form of wired or wireless communication methods. For example, the user interface communication module 214 may comprise a Bluetooth communication module and may be configured to couple with, e.g. tether to, the user interface device 216 using Bluetooth.

The user interface device 216 may run specific software, such as an app, which provides the user with a suitable user interface, such as a graphical user interface, allowing the user to easily adjust the settings of the personal mixer 206 and personal equaliser 208. The user interface device 216 communicates with the personal audio mixer device 200 via the interface communication module 214 to communicate any audio content settings, which have been input by the user using the user interface device 216.

The user interface device 216 and the personal audio mixing device 200 may communicate in real time to allow the user to adjust the mix and equalisation of the audio delivered by the personal audio mixing device 200 during the concert. For example, the user may wish to adjust the audio content settings according to the performer or the stage on a specific song being performed.

The personal audio mixer device 200 also comprises a Near Field Communication (NFC) module 218. The NFC module 218 may comprise an NFC tag which can be read by an NFC reader provided on the using interface device 216. The NFC tag may comprise authorisation data which can be read by the user interface device 216, to allow the user interface device 216 to couple with the personal audio mixing device 200, e.g. with the user interface communication module 214. Additionally or alternatively, the authorisation data may be used by the user interface device 216 to access another service provided at the performance venue.

The NFC module 218 may further comprise an NFC radio. The radio may be configured to communicate with the user interface device 216 to receive an audio content setting from the user interface device 216. Alternatively, the NFC radio may read an audio content setting from another source such as an NFC tag provided on a concert ticket, or smart poster at the venue.

The personal audio mixer device 200 further comprises a microphone 210. The microphone 210 may be a single channel microphone. Alternatively the microphone 210 may be a stereo or binaural microphone. The microphone 210 is configured to record an ambient sound at the location of the user, for example the microphone may record the sound of the crowd and the sound received by the user from the speakers 16 and additional speakers 18. The sound is converted by the microphone 210 to an acoustic audio signal 211, which is input to the personal mixer 206. The user of the personal audio mixing device can adjust the relative volume of the acoustic audio signal 211 together with the decoded audio signals 203. This may allow the user of the device 200 to continue experiencing the sound of the crowd at a desired volume whilst listening to the personal audio mix created on the personal audio mixing device 200.

Prior to being input to the personal mixer 206, the acoustic audio signal 211 is input to an audio processor 212. The audio processor 212 also receives the decoded audio signals 203 from the decoder 204. The audio processor 212 may process the acoustic audio signal 211 and the decoded audio signals 203 to determine a delay between the acoustic audio signal 211 recorded by the microphone 210 and the decoded audio signals received and decoded from the wireless signal 130 transmitted by the multi-channel transmitter 124.

Figure 6:
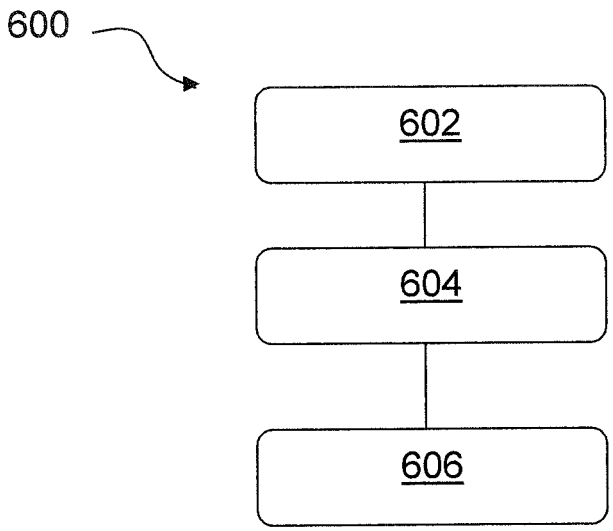
FIG. 6 shows a previously proposed method of synchronising an audio signal.

With reference to FIG. 6, in a previously proposed arrangement the audio processor 121 is configured to processes the acoustic audio signal 211 and the decoded audio signals 203 according to a method 600. In a first step 602, the acoustic audio signal 211 and the decoded audio signals 211 are processed to produce one or more metadata streams relating the acoustic audio signal 211 and the decoded audio signals 203 respectively. The metadata streams may contain information relating to the waveforms of the acoustic audio signal and/or the decoded audio signals. Additionally or alternatively, the metadata streams may comprise timing information.

In a second step 604, the previously proposed audio processor combines the metadata streams relating to one or more of the decoded audio channels to generate a combined metadata steam, which corresponds to the metadata steam generated from the acoustic audio signal. The audio processor 212 may combine different combinations of metadata streams before selecting a combination which it considered to correspond. It will be appreciated that the audio processor 212 may alternatively combine the decoded audio signals 203 prior to generating the metadata streams in order to provide the combined metadata steam.

In a third step 606, the previously proposed audio processor compares the combined metadata stream with the metadata stream relating to the acoustic audio signal 211 to determine a delay between the acoustic audio signal 211 recorded by the microphone 210, and the decoded audio signals 203.

The audio processor 212 may delay one, some or each of the decoded audio signals 203 by the determined delay and may input one or more delayed audio signals 213 to the personal mixer 206. This allows the personal audio content being created on the personal audio mixing device 200 to be synchronised with the sounds being heard by the user from the speakers 16 and additional speakers 18, e.g. the ambient audio at the location of the user.

As the user moves around the audience area 4, and the distance between the audience member and the speakers 16, 18 varies, the required delay may vary also. Additionally or alternatively, environmental factors such as changes in temperature and humidity may affect the delay between the acoustic audio signal 211 and the decoded audio signals 203. These effects may be emphasised the further an audience member is from the speakers 16, 18.

In order to maintain synchronisation of the personal audio content created by the device, with the ambient audio, the audio processor 212 may continuously update the delay being applied to the decoded audio signals 203. It may therefore be desirable for the audio processor 212 to reduce the time taken for the audio processor 212 to perform the steps to determine the delay.

In some cases, the time taken for the audio processor 212, following the previously proposed method 600, to process the decoded audio signals 203 and the acoustic audio signal 211 to generate the metadata, produce the necessary combined metadata, and compare the metadata to determine the delay, may exceed the length of the delay required. During the time taken to determine the delay to be applied, the required delay may vary by a detectable amount, e.g. detectable by the user, such that applying the determined delay does not correctly synchronise the personal audio content created by the personal audio mixing device 200 with the ambient audio content at the location of the user, e.g. the sound received from the speakers 16,18.

In order to reduce the time taken by the audio processor to determine the required delay, the audio workstation may be configured to generate at least one of the combined audio signals 128, such that it corresponds to the acoustic audio signal. For example, the combined audio signal 128 may be configured to correspond to the stage mix being projected by the speakers 16, 18. The audio processor 212 may then process only the acoustic audio signal 211 and the decoded audio signal 203 that corresponds to the stage mix, and hence the ambient audio content recorded by the microphone 210 to provide the acoustic audio signal 211.

Figure 7:
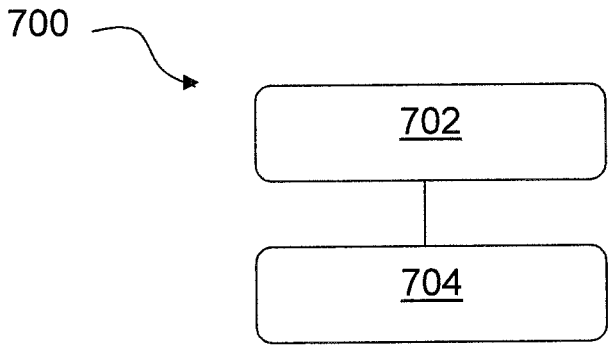
FIG. 7 shows a method of synchronising an audio signal, according to an embodiment of the present disclosure.

In order to further reduce the time taken by the audio processor 212 to determine the delay, the audio processor 212 may be configured to receive the metadata 129, which is transmitted wirelessly from the multi-channel transmitter 124. With reference to FIG. 7, the audio processor 212 may determine a required delay using a method 700, according to an arrangement of the present disclosure.

In a first step 702, the acoustic audio signal 211 is processed to produce a metadata stream. In a second step 704 the metadata stream relating to the acoustic audio signal is compared with the wirelessly received metadata 205, to determine a delay between the acoustic audio signal 211 and the decoded audio signals 203.

As described above, the metadata 129 transmitted by the multi-channel transmitter 124 and received wirelessly by the personal audio mixer 200 may relate to an audio content generated by the audio workstation that corresponds to the stage mix being projected by the speakers 16, 18. Hence, the wirelessly received metadata 205 may be suitable for comparing with the metadata stream generated from the acoustic audio signal 211 to determine the delay. In addition, by applying the wirelessly received metadata 205 to determine the required delay, rather than processing the decoded audio signals 203 to generate one or more metadata streams, the audio processor 212 may calculate the delay faster. This may lead to improved synchronisation between the personal audio content and the ambient audio heard by the user.

It will be appreciated that the personal audio mixing device 200 may comprise one or more controllers configured to perform the functions of one or more of the audio signal receiver 202, the decoder 204, the personal mixer 206, the personal equaliser 208, the user interface communication module 214 and the audio processor 212, as described above. The controllers may comprise one or more modules. Each of the modules may be configured to perform the functionality of one of the above-mentioned components of the personal audio mixing device 200. Alternatively, the functionality of one or more of the components mentioned above may be split between the modules or between the controllers. Furthermore, the or each of the modules may be mounted in a common housing or casing, or may be distributed between two or more housings or casings.

Although the disclosure has been described by way of example, with reference to one or more examples, it is not limited to the disclosed examples and other examples may be created without departing from the scope of the disclosure, as defined by the appended claims.

What is claimed is:

1. A method of synchronizing one or more wirelessly received audio signals with an acoustically received audio signal, the method comprising:

receiving an electromagnetic signal using a first wireless communication method, the electromagnetic signal comprising:

the one or more wirelessly received audio signals; and a wirelessly received metadata that relates to a waveform of a remote audio content;

determining a delay between the acoustically received audio signal and the one or more wirelessly received audio signals by referring the acoustically received audio signal to the wirelessly received metadata that relates to the waveform of the remote audio content; and delaying the one or more audio signals by the determined delay.

2. The method of claim 1, wherein the method further comprises:

processing the acoustically received audio signal to determine an acoustic metadata; and wherein the delay between the acoustically received audio signal and the one or more wirelessly received audio signals is determined by comparing the acoustic metadata with the wirelessly received metadata.

3. The method of claim 1, wherein the acoustically received audio signal is recorded by a transducer configured to convert an ambient audio content into the acoustically received audio signal.

4. The method of claim 1, wherein the remote audio content is configured to correspond to the acoustically received audio signal.

5. The method of claim 1, wherein the electromagnetic signal comprises a multiplexed audio signal; and wherein the method further comprises demultiplexing the multiplexed audio signal to obtain the one or more wirelessly received audio signals.

6. The method of claim 1, wherein the wireless signal is a digitally modulated signal.

7. The method of claim 1, wherein the electromagnetic signal comprises a plurality of wirelessly received audio signals, and wherein the method further comprises:

receiving an audio content setting from a user interface device;

adjusting the relative volumes of the wirelessly received audio signals according to the audio content setting to provide a plurality of adjusted audio signals; and combining the adjusted audio signals to generate a custom audio content.

8. The method of claim 7, wherein the audio content setting is received using a second wireless communication method.

9. The method of claim 8, wherein the first wireless communication method has a longer range than the second wireless communication method.

10. The method of claim 1, wherein at least one of the wirelessly received audio signals corresponds to the remote audio content.

11. The method of claim 1, wherein the wirelessly received metadata comprises timing information relating to the remote audio content.

12. The method of claim 1, wherein the wirelessly received metadata comprises information relating to a waveform of the remote audio content.

13. An audio synchronizer comprising:

a wireless receiver configured to receive an electromagnetic signal using a first wireless communication method, the signal comprising:

one or more wirelessly received audio signals; and a wirelessly received metadata relating to a remote audio content; and a controller configured to perform the method of claim 1.

14. A system for synchronizing one or more wirelessly received audio signals with an acoustically received audio signal, the system comprising:

an audio workstation configured to:

generate a metadata relating to an audio content; and provide a signal comprising:

one or more audio signals; and the metadata;

a transmitter configured to:

receive the signal from the audio workstation; and transmit the signal using a first wireless communication method; and the audio synchronizer of claim 13.

15. The audio synchronizer of claim 14, wherein the audio workstation is further configured to generate the audio content from a plurality of audio channels provided to the audio workstation.

16. The audio synchronizer of claim 14, wherein the audio workstation is further configured to generate the one or more audio signals from a plurality of audio channels provided to the audio workstation.

17. The audio synchronizer of claim 15, wherein at least one of the audio signals corresponds to the audio content.

18. The audio synchronizer of claim 14, wherein the audio content is configured to correspond to the acoustically received audio signal.

19. A system comprising the audio synchronizer of claim 14, and a speaker system configured to provide the acoustically received audio signal.

* * * * *